US009773459B2

(12) United States Patent
Ikeda

(10) Patent No.: US 9,773,459 B2
(45) Date of Patent: Sep. 26, 2017

(54) IMAGE DISPLAY APPARATUS THAT HAS A LIGHT EMITTING UNIT AND METHOD OF CONTROLLING SAME

(71) Applicant: CANON KABUSHIKI KAISHA, Tokyo (JP)

(72) Inventor: Takeshi Ikeda, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 114 days.

(21) Appl. No.: 14/303,971

(22) Filed: Jun. 13, 2014

(65) Prior Publication Data

US 2014/0368558 A1 Dec. 18, 2014

(30) Foreign Application Priority Data

Jun. 14, 2013 (JP) ..... 2013-125312
May 23, 2014 (JP) ..... 2014-107371

(51) Int. Cl.
*G09G 3/34* (2006.01)

(52) U.S. Cl.
CPC ... *G09G 3/3426* (2013.01); *G09G 2320/0247* (2013.01); *G09G 2320/0285* (2013.01); *G09G 2320/066* (2013.01); *G09G 2320/0646* (2013.01); *G09G 2320/103* (2013.01)

(58) Field of Classification Search
CPC ..... G09G 3/3426; G09G 2320/0247; G09G 2320/0285; G09G 2320/0646; G09G 2320/066; G09G 2320/103
See application file for complete search history.

(56) References Cited

U.S. PATENT DOCUMENTS 5,745,190 A * 4/1998 Ioka ..... H04N 5/144 348/700
6,791,527 B2 * 9/2004 Yoshinaga ..... G09G 3/3406 345/102
7,298,358 B2 * 11/2007 Honbo ..... G09G 3/342 345/102
7,667,721 B2 * 2/2010 Minami ..... H04N 5/20 345/690
8,130,325 B2 * 3/2012 Iwakura ..... G09G 3/288 348/673
8,207,953 B2 * 6/2012 Yamamura ..... G09G 3/3426 345/102

(Continued)

FOREIGN PATENT DOCUMENTS

JP 2002-099250 A 4/2002

*Primary Examiner* — Peter D McLoone
(74) *Attorney, Agent, or Firm* — Cowan, Liebowitz & Latman, P.C.

(57) ABSTRACT

An image display apparatus includes: a light-emitting unit having a plurality of light sources capable of controlling emission brightness individually; a display unit that displays an image on a screen; and a control unit that controls the respective emission brightnesses of the respective light sources according to images of regions on the screen corresponding to the respective light sources. When a difference between an image of a subject frame and an image of a past frame earlier than the subject frame is caused from movement of a predetermined object, the control unit suppresses the emission brightness of a light source corresponding to an image region of the subject frame brighter than that of the past frame from changing from the emission brightness of a light source corresponding to this image region of the past frame.

14 Claims, 12 Drawing Sheets

(56) References Cited

U.S. PATENT DOCUMENTS 8,493,313 B2 * 7/2013 Damberg ..... G09G 3/3426 345/102
8,711,083 B2 * 4/2014 Lee ..... G09G 3/3426 345/102
9,047,829 B2 * 6/2015 Tanaka ..... G09G 3/3426
2001/0043179 A1 * 11/2001 Yoshinaga ..... G09G 3/3406 345/87
2005/0062681 A1 * 3/2005 Honbo ..... G09G 3/342 345/10
2008/0062101 A1 * 3/2008 Minami ..... H04N 5/20 345/89
2009/0201320 A1 * 8/2009 Damberg ..... G09G 3/3426 345/694
2010/0002009 A1 * 1/2010 Takata ..... G09G 3/3426 345/589
2010/0103089 A1 * 4/2010 Yoshida ..... G09G 3/2022 345/102
2010/0220048 A1 * 9/2010 Yamamura ..... G09G 3/3426 345/102
2010/0265405 A1 * 10/2010 Toshima ..... G09G 3/3426 348/687
2010/0295767 A1 * 11/2010 Lee ..... G09G 3/3426 345/102
2010/0295879 A1 * 11/2010 Tanaka ..... G09G 3/3426 345/690
2010/0321581 A1 * 12/2010 Iwakura ..... G09G 3/288 348/687
2011/0298839 A1 * 12/2011 Nakanishi ..... G09G 3/3426 345/690
2014/0176623 A1 * 6/2014 Inoue ..... G09G 3/2003 345/690
2014/0232764 A1 * 8/2014 Nishio ..... G09G 3/3426 345/690
2014/0354708 A1 * 12/2014 Ikeda ..... G09G 3/3426 345/690

* cited by examiner

| | 1 | 2 | 3 | 4 | 5 | 6 | 7 | 8 |
|---|---|---|---|---|---|---|---|---|
| 1 | 0 | 0 | 0 | 0 | 0 | 0 | 0 | 0 |
| 2 | 0 | 0 | 255 | 0 | 0 | 0 | 160 | 0 |
| 3 | 0 | 0 | 0 | 0 | 0 | 0 | 160 | 0 |
| 4 | 0 | 128 | 0 | 0 | 0 | 160 | 160 | 160 |
| 5 | 0 | 128 | 0 | 0 | 0 | 160 | 160 | 160 |
| 6 | 32 | 128 | 128 | 128 | 128 | 160 | 160 | 160 |

*Fig.2A*

| | 1 | 2 | 3 | 4 | 5 | 6 | 7 | 8 |
|---|---|---|---|---|---|---|---|---|
| 1 | 0 | 0 | 0 | 0 | 0 | 0 | 0 | 0 |
| 2 | 0 | 0 | 0 | 0 | 255 | 255 | 160 | 0 |
| 3 | 0 | 0 | 0 | 0 | 0 | 0 | 160 | 0 |
| 4 | 0 | 128 | 0 | 0 | 0 | 160 | 160 | 160 |
| 5 | 0 | 128 | 0 | 0 | 0 | 160 | 160 | 160 |
| 6 | 32 | 128 | 128 | 128 | 128 | 160 | 160 | 160 |

*Fig.2B*

| | 1 | 2 | 3 | 4 | 5 | 6 | 7 | 8 |
|---|---|---|---|---|---|---|---|---|
| 1 | 0 | 0 | 0 | 0 | 0 | 0 | 0 | 0 |
| 2 | 0 | 0 | 0 | 0 | 0 | 0 | 160 | 0 |
| 3 | 0 | 0 | 0 | 0 | 0 | 0 | 160 | 0 |
| 4 | 0 | 128 | 0 | 0 | 0 | 160 | 160 | 160 |
| 5 | 0 | 128 | 0 | 0 | 0 | 160 | 160 | 160 |
| 6 | 32 | 128 | 128 | 128 | 128 | 160 | 160 | 160 |

*Fig.3*

| NUMBER OF PIXELS OF WHICH BRIGHTNESS HAS CHANGED | UPDATE MODE |
|---|---|
| 0 | 2 |
| 0<NUMBER OF PIXELS≦400 | 1 |
| 400<NUMBER OF PIXELS | 0 |

*Fig.4*

| | 1 | 2 | 3 | 4 | 5 | 6 | 7 | 8 |
|---|---|---|---|---|---|---|---|---|
| 1 | 0 | 0 | 0 | 0 | 0 | 0 | 0 | 0 |
| 2 | 0 | 0 | 0 | 0 | 0 | 0 | 63 | 0 |
| 3 | 0 | 0 | 0 | 0 | 0 | 0 | 63 | 0 |
| 4 | 0 | 50 | 0 | 0 | 0 | 63 | 63 | 63 |
| 5 | 0 | 50 | 0 | 0 | 0 | 63 | 63 | 63 |
| 6 | 12 | 50 | 50 | 50 | 50 | 63 | 63 | 63 |

*Fig.6*

| | 1 | 2 | 3 | 4 | 5 | 6 | 7 | 8 |
|---|---|---|---|---|---|---|---|---|
| 1 | 0 | 0 | 0 | 0 | 0 | 0 | 0 | 0 |
| 2 | 0 | 0 | 0 | 0 | 100 | 100 | 63 | 0 |
| 3 | 0 | 0 | 0 | 0 | 0 | 0 | 63 | 0 |
| 4 | 0 | 50 | 0 | 0 | 0 | 63 | 63 | 63 |
| 5 | 0 | 50 | 0 | 0 | 0 | 63 | 63 | 63 |
| 6 | 12 | 50 | 50 | 50 | 50 | 63 | 63 | 63 |

*Fig.8A*

| | 1 | 2 | 3 | 4 | 5 | 6 | 7 | 8 |
|---|---|---|---|---|---|---|---|---|
| 1 | 0 | 0 | 0 | 0 | 0 | 0 | 0 | 0 |
| 2 | 0 | 0 | 100 | 0 | 0 | 0 | 63 | 0 |
| 3 | 0 | 0 | 0 | 0 | 0 | 0 | 63 | 0 |
| 4 | 0 | 50 | 0 | 0 | 0 | 63 | 63 | 63 |
| 5 | 0 | 50 | 0 | 0 | 0 | 63 | 63 | 63 |
| 6 | 12 | 50 | 50 | 50 | 50 | 63 | 63 | 63 |

*Fig.8B*

| UPDATE MODE | SCENE DETERMINATION = 0 | SCENE DETERMINATION = 1 |
|---|---|---|
| 2 | DO NOT UPDATE ALL BLOCKS | UPDATE ALL BLOCKS |
| 1 | UPDATE ONLY ORIGINATING BLOCK OF CURSOR | UPDATE ALL BLOCKS |
| 0 | UPDATE ALL BLOCKS | UPDATE ALL BLOCKS |

*Fig.10*

IMAGE DISPLAY APPARATUS THAT HAS A LIGHT EMITTING UNIT AND METHOD OF CONTROLLING SAME

BACKGROUND OF THE INVENTION

Field of the Invention

The present invention relates to an image display apparatus and a method of controlling the same.

Description of the Related Art

In a liquid crystal display apparatus, there is a technique of forming a backlight by a plurality of light sources of which emission brightness can be changed individually, and of controlling the emission brightness of the light sources and the transmittance of liquid crystal in respective regions on the screen corresponding to the respective light sources, on the basis of an image to be displayed in the regions (for example, see Japanese patent laid-open publication No. 2002-99250). According to this technique, it is possible to suppress a black spot from being noticed in a dark image portion and to improve the contrast.

SUMMARY OF THE INVENTION

However, in an image editing display or a color management display used for checking posters, web designs, and the like, it is necessary to reproduce input images accurately. In an image output from a personal computer, an image of an object for assisting a user's operation such as a mouse cursor (hereinafter referred to as a cursor) is often superimposed on the original image that is to be reproduced accurately. When the control of changing the brightness of the backlight and the transmittance of the liquid crystal is applied to such an image based on the image signals of the respective image regions, the brightness of the cursor is also reproduced accurately. As a result, when the cursor is placed on a dark region of the original image, a light source corresponding to the region where the cursor is present is lit bright in order to reproduce the brightness of the cursor accurately. Moreover, when the light source corresponding to the region where the cursor is present is lit bright, light may leak into the surrounding regions (this leakage is referred to as "halo effect" in the present specification), which may cause a sense of disturbance to the user.

FIG. 11 illustrates an image in which a high brightness (white) cursor moves in a dark region of an original image. In FIG. 11, a light source corresponding to a region where the cursor is present is lit bright, and the halo effect occurs in the surrounding region of the region where the cursor is present. When the cursor moves in the direction from A to B in FIG. 11, since the halo effect is also noticed with the movement of the cursor, if such movement occurs frequently, the observer may experience the flicker effect.

The present invention suppresses the halo effect and the flicker effect caused by movement of an object image such as a cursor image in an image display apparatus which includes a plurality of light sources capable of changing the emission brightness individually and which controls the emission brightness of the respective light sources according to the image of the image regions corresponding to the light sources.

According to a first aspect of the present invention, there is provided an image display apparatus including: a light-emitting unit having a plurality of light sources capable of controlling emission brightness individually; a display unit that displays an image on a screen by modulating light from the light-emitting unit; and a control unit that controls the respective emission brightnesses of the respective light sources according to images of regions on the screen corresponding to the respective light sources, wherein when a difference between an image of a subject frame in which emission brightness is to be determined and an image of a past frame earlier than the subject frame is caused from movement of a predetermined object, the control unit suppresses the emission brightness of a light source corresponding to an image region of the subject frame brighter than that of the past frame from changing from the emission brightness of a light source corresponding to this image region of the past frame.

According to a second aspect of the present invention, there is provided a method of controlling an image display apparatus including: a light-emitting unit having a plurality of light sources capable of controlling emission brightness individually; a display unit that displays an image on a screen by modulating light from the light-emitting unit, the method including: controlling the respective emission brightnesses of the respective light sources according to images of regions on the screen corresponding to the respective light sources, wherein in controlling, when a difference between an image of a subject frame in which emission brightness is to be determined and an image of a past frame earlier than the subject frame is caused from movement of a predetermined object, the emission brightness of a light source corresponding to an image region of the subject frame brighter than that of the past frame is suppressed from changing from the emission brightness of a light source corresponding to this image region of the past frame.

According to the present invention, an image display apparatus which includes a plurality of light sources capable of changing the emission brightness individually and which controls the emission brightness of the respective light sources according to the image of the image regions corresponding to the light sources can suppress the halo effect and the flicker effect caused by movement of an object image such as a cursor image.

Further features of the present invention will become apparent from the following description of exemplary embodiments (with reference to the attached drawings).

BRIEF DESCRIPTION OF THE DRAWINGS

FIGS. 2A and 2B illustrate examples of a feature amount of each block acquired according to the first embodiment;

FIG. 3 illustrates an example of feature amounts stored in a feature amount storage unit according to the first embodiment;

FIG. 4 illustrates an example of a table illustrating the relationship between the number of pixels of which the brightness has changed and an update mode in the first embodiment;

FIG. 6 illustrates an example of backlight brightness in respective blocks according to the first embodiment;

FIGS. 8A and 8B illustrate examples of backlight brightness in respective blocks according to the second embodiment;

FIG. 10 illustrates the relationship among an update mode, a scene determination result, and an updating block selection method according to the third embodiment.

DESCRIPTION OF THE EMBODIMENTS

First Embodiment

Embodiments of the present invention will be described with reference to the drawings.

An image display apparatus according to a first embodiment calculates the number of pixels (hereinafter referred to a motion amount) of which the brightness has changed among the pixels of the entire screen. The image display apparatus detects a cursor movement by determining whether the motion amount results from a cursor movement based on whether the motion amount is equal to or smaller than a largest number of pixels of which the brightness can change when an object (auxiliary object) for assisting a user's operation, such as a cursor (for example, a mouse cursor) moves. The image display apparatus generates a feature amount if no cursor were present in a current frame from a feature amount of the current frame and a stored feature amount of a past frame when the cursor movement is detected. The image display apparatus determines a brightness of a backlight from the generated feature amount. By doing so, an image display apparatus that performs local dimming control for improving the contrast can suppress the halo effect and the flicker effect when a high brightness cursor moves in a dark region of an original image. A first embodiment will be described in detail below.

Figure 1:
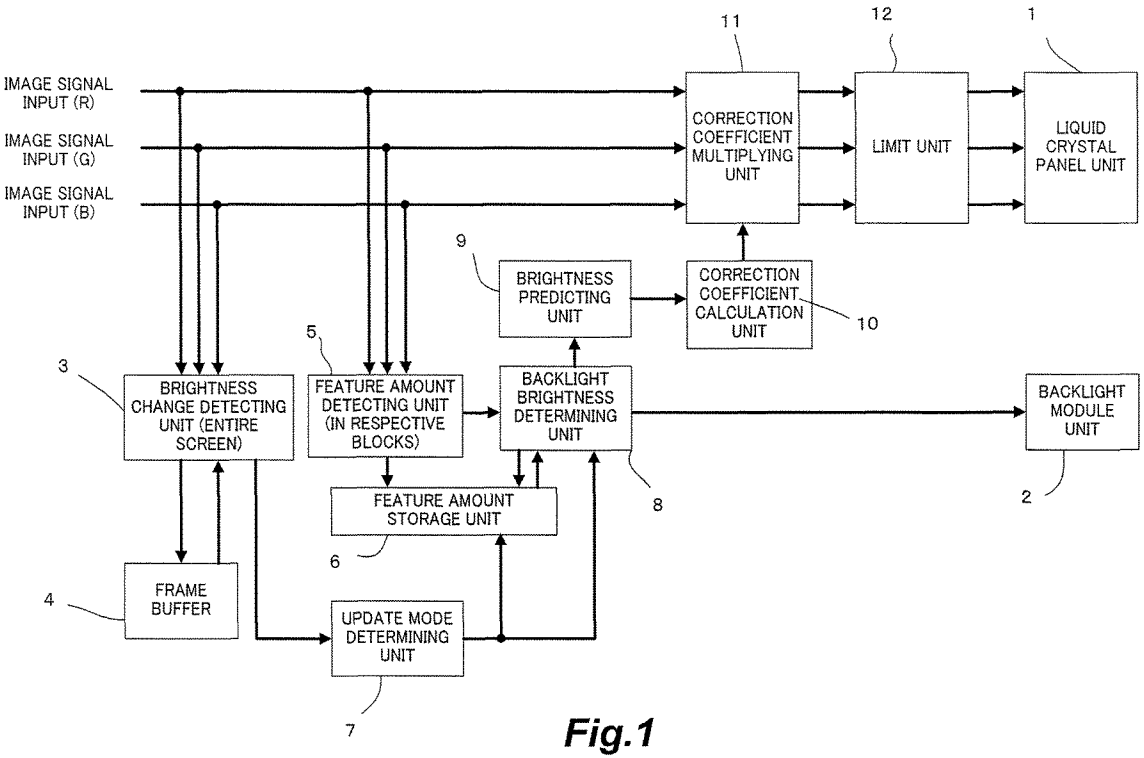
FIG. 1 is a functional block diagram of an image display apparatus according to a first embodiment.

FIG. 1 illustrates a functional block diagram of an image display apparatus according to the first embodiment. The image display apparatus illustrated in FIG. 1 includes a liquid crystal panel unit 1, a backlight module unit 2, a brightness change detecting unit 3, a frame buffer 4, a feature amount detecting unit 5, a feature amount storage unit 6, an update mode determining unit 7, a backlight brightness determining unit 8, a brightness predicting unit 9, a correction coefficient calculation unit 10, a correction coefficient multiplying unit 11, and a limit unit 12.

The liquid crystal panel unit 1 includes a liquid crystal driver, a control substrate that receives an input image signal and controls the liquid crystal driver, and a liquid crystal panel. The liquid crystal panel unit 1 is a display panel that displays an image on a screen by modulating light from the backlight module unit 2. In the present embodiment, an example in which the present invention is applied to a transmissive image display apparatus including a liquid crystal panel as a display panel is described. However, an application of the present invention is not limited to a liquid crystal display apparatus. It is sufficient that the image display apparatus is an image display apparatus having an independent light source. For example, the image display apparatus may be a reflective liquid crystal display apparatus. Moreover, the image display apparatus may be a micro electro mechanical system (MEMS) shutter display which uses a MEMS shutter instead of a liquid crystal device.

The backlight module unit 2 includes light-emitting devices for backlight, a control circuit that controls emission of the light-emitting devices, and an optical unit for diffusing light from the light-emitting devices. The backlight is divided into a plurality of regions, each region including one or a plurality of light-emitting devices, and emission is controlled in units of respective regions. The regions serving as the units of emission control are referred to as "light sources" in the present specification. That is, the backlight includes a plurality of light sources in which emission brightness can be controlled individually, and each light source is made up of one or a plurality of light-emitting devices. It is assumed that the backlight is divided into m by n regions in horizontal and vertical directions, respectively (where m and n are integers). In the present embodiment, the backlight is divided into 8 by 6 regions in horizontal and vertical directions, respectively. The backlight module unit 2 receives the brightness determined by the backlight brightness determining unit 8 and drives the respective light sources so that the emission brightness of the respective light source becomes the received brightness.

The brightness change detecting unit 3 reads image data stored in the frame buffer 4, compares image data of the current frame with image data of a past frame (in the present embodiment, a frame immediately before the current frame), detects pixels of which the brightness has changed, and counts the number of such pixels. The brightness change detecting unit 3 outputs the counted value to the update mode determining unit 7. The image of the past frame compared with the image of the current frame is not limited to the image of the frame immediately before the current frame but may be an image of a frame that is two frames or more before the current frame.

The frame buffer 4 stores image data of one frame. The brightness change detecting unit 3 erases the image data of the past frame which has been compared and stores the image data of the current frame which has been compared.

The feature amount detecting unit 5 divides the image into blocks corresponding to the respective light sources of the backlight and detects feature amounts of respective blocks. The feature amount detecting unit 5 transmits the detected feature amounts to the feature amount storage unit 6 and the backlight brightness determining unit 8 which are on the subsequent stage. In the present embodiment, the feature amount detecting unit 5 detects the largest values of the RGB pixel values of respective blocks.

Figure 11:
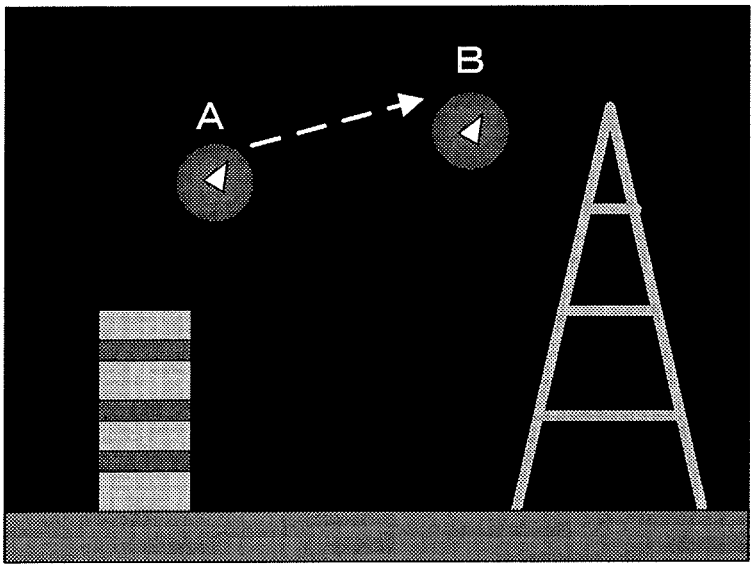
FIG. 11 illustrates an example of a subject image.

An input image illustrated in FIG. 11 will be described by way of an example. The largest pixel values of respective blocks when a cursor is positioned at positions A and B in FIG. 11 are illustrated in FIGS. 2A and 2B, respectively. It is assumed that a gradation value of a pixel that constitutes a cursor image is 255. Since the cursor is present at the position of a coordinate (3,2) of FIG. 2A and coordinates (5,2) and (6,2) of FIG. 2B, a value of 255 is detected as a largest pixel value of the coordinates.

The feature amount storage unit 6 stores the feature amounts of the respective blocks detected by the feature amount detecting unit 5. The feature amounts are stored when the determination result in the update mode determining unit 7 described later is received. The update mode determining unit 7 sets any one of update modes 0, 1, and 2.

In the update mode 0, the feature amount storage unit updates the stored feature amounts with the feature amounts of the current frame detected by the feature amount detecting unit 5 with respect to all blocks.

In the update mode 1, the feature amount storage unit updates the stored feature amounts with the feature amounts of the current frame detected by the feature amount detecting unit 5 with respect to only blocks in which the feature amounts of the current frame detected by the feature amount detecting unit 5 has decreased. Specifically, the feature amount storage unit 6 reads the largest pixel values stored for respective blocks and compares the largest pixel values of the respective blocks with the largest pixel value detected by the feature amount detecting unit 5 for the current frame. For blocks in which the largest pixel value of the current frame is smaller than the stored largest pixel value, the feature amount storage unit 6 updates the stored largest pixel value with the largest pixel value of the current frame. On the other hand, for blocks in which the largest pixel value of the current frame is equal to or larger than the stored largest pixel value, the feature amount storage unit 6 does not update the stored largest pixel values.

In the update mode 2, the feature amount storage unit 6 does not update the stored feature amounts with respect to all blocks.

Upon receiving a determination result indicating the update mode 1 from the update mode determining unit 7, the feature amount storage unit 6 updates the feature amounts in the following manner. For example, a case where the largest pixel values of respective blocks have changed from FIG. 2A to FIG. 2B will be described. Since the largest pixel value of the block of the coordinate (3,2) is 255 in FIG. 2A, which has changed to 0 in FIG. 2B, the largest pixel value has decreased when the largest pixel value has changed from FIG. 2A to FIG. 2B. Thus, the feature amount storage unit 6 updates the largest pixel value stored for the block of the coordinate (3,2) with the largest pixel value of FIG. 2B. On the other hand, since the largest pixel value of the block of the coordinate (5,2) has increased from 0 to 255, the feature amount storage unit 6 does not update the largest pixel value stored for this block. The same is true for the block of the coordinate (6,2). Since the largest pixel values of the other blocks are the same as those of FIG. 2A and FIG. 2B, the feature amount storage unit 6 does not update the largest pixel values stored for these blocks. In this manner, when the past frame has feature amounts as illustrated in FIG. 2A and the current frame has feature amounts as illustrated in FIG. 2B, the feature amounts illustrated in FIG. 2A are updated as illustrated in FIG. 3.

Upon receiving a determination result indicating the update mode 0 from the update mode determining unit 7, the feature amount storage unit 6 updates the largest pixel values stored for all blocks with the largest pixel values detected by the feature amount detecting unit 5 for the current frame.

Upon receiving a determination result indicating the update mode 2 from the update mode determining unit 7, the feature amount storage unit 6 does not update the largest pixel values stored for all blocks.

The feature amount storage unit 6 outputs the stored feature amounts in response to the request from the backlight brightness determining unit 8.

The update mode determining unit 7 determines the feature amount update mode of the feature amount storage unit 6 according to a detection result in the brightness change detecting unit 3. Specifically, when the number of pixels of which the brightness has changed is equal to or smaller than a threshold, the update mode determining unit sets the update mode 1. That is, an update mode of updating the feature amounts of only blocks in which the feature amount (largest pixel value) has decreased is set. The threshold is determined based on the number of pixels of which the brightness has changed with movement of the cursor.

FIG. 4 illustrates the relationship between the update mode and the number of pixels of which the brightness has changed according to the present embodiment. In the present embodiment, it is assumed that the number of pixels of an input image is 1920 by 1080 pixels in the horizontal and vertical directions, respectively. It is also assumed that the number of pixels of the cursor image is 200 pixels or smaller. When the cursor moves, it is highly likely that the brightness of a destination block changes from that of a block in which cursor existed before moving.

When there is a pixel of which the brightness has changed, and the number of such pixels is 400 pixels or smaller (400=200×2), the update mode determining unit 7 determines that the cursor has moved and sets the update mode 1. In this case, the feature amounts stored for blocks in which the feature amount has increased are not updated, but the feature amounts stored for only blocks in which the feature amount has decreased are updated. By doing so, an increase in the brightness of the destination block of the cursor is suppressed, and the brightness of the block in which cursor existed before moving decreases. Thus, the halo effect is suppressed and the occurrence of the flicker effect caused by movement of a halo with the movement of the cursor is suppressed.

When there is a pixel of which the brightness has changed and the number of such pixels exceeds 400 pixels, the update mode determining unit 7 determines that the input image is a still image and has changed or that the input image is a moving image and sets the update mode 0. In this case, the feature amounts stored for all blocks are updated. Thus, all blocks have the brightness corresponding to the image of the current frame and the image is displayed with high contrast.

When there is no pixel of which the brightness has changed (that is, number of such pixels is 0), the update mode determining unit 7 determines that there is no change in the images of the two subsequent frames and sets the update mode 2. Thus, the stored feature amounts are not updated.

The update mode determining unit 7 transmits information on the update mode determined in this manner to the feature amount storage unit 6 and the backlight brightness determining unit 8.

The backlight brightness determining unit 8 determines the brightness of the respective backlight light sources based on the feature amounts detected by the feature amount detecting unit 5 or the feature amounts stored in the feature amount storage unit 6. Which one of the feature amounts detected by the feature amount detecting unit 5 and the feature amounts stored in the feature amount storage unit 6 will be used for determining the backlight brightness is determined based on the update mode determined by the update mode determining unit 7. When the update mode 1 or 2 is set, the backlight brightness determining unit 8 calculates the backlight brightness using the feature amounts stored in the feature amount storage unit 6. When the update mode 0 is set, the backlight brightness determining unit 8 calculates the backlight brightness using the feature amounts detected by the feature amount detecting unit 5.

Figure 5:
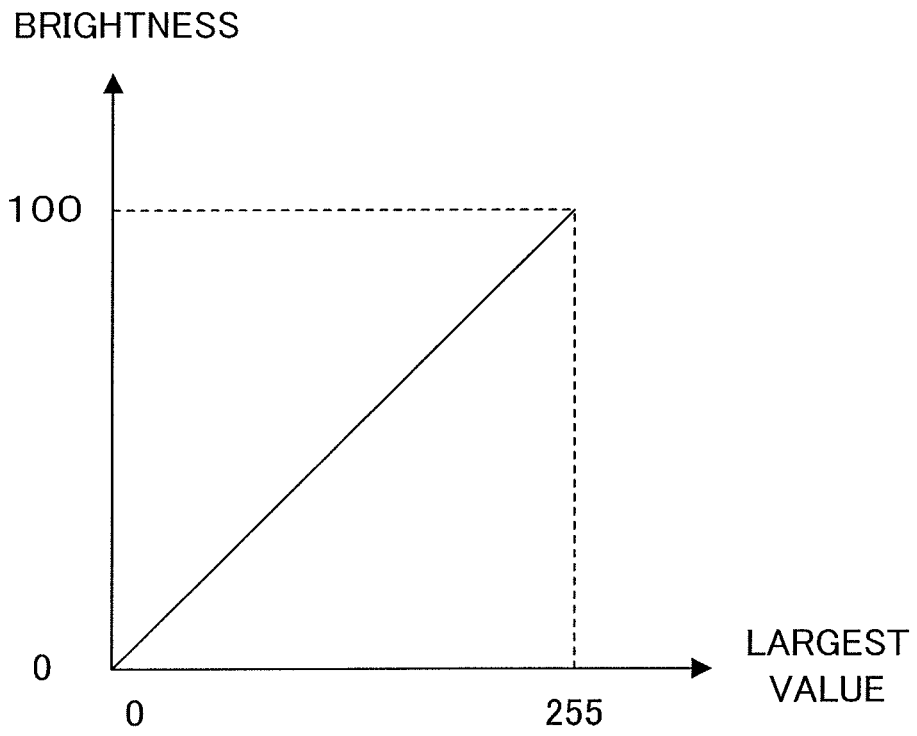
FIG. 5 illustrates a lookup table for determining backlight brightness according to the first embodiment.

The backlight brightness determining unit 8 determines the emission brightness of the light sources corresponding to the respective blocks based on the feature amounts (largest pixel values in the present embodiment) of the respective blocks and information on the correspondence between the backlight brightness and the feature amounts stored as a lookup table. FIG. 5 illustrates an example of the lookup table. FIG. 5 illustrates a largest pixel value as an input value on the horizontal axis and a backlight brightness as an output value on the vertical axis. A backlight brightness of 0 indicates a state where a light source is not lit and a backlight brightness of 100 indicates a state where a light source is lit with highest brightness.

FIG. 6 illustrates the emission brightness of respective light sources, determined with reference to the lookup table of FIG. 5 when the respective blocks have such feature amounts (largest pixel values) as illustrated in FIG. 3. As illustrated in FIG. 6, when the cursor has moved as illustrated in the image of FIG. 11, the brightness of a light source corresponding to the block of the coordinate (3,2) which is the block in which cursor existed before moving is determined to be 0. Moreover, the brightness of a light source corresponding to the blocks of the coordinates (5,2) and (6,2) which are the destination blocks of the cursor is determined to be 0. From this fact, it can be understood that both the halo effect resulting from the presence of a predetermined object (in this example, a mouse cursor as an auxiliary object for assisting a user's operation) configured as a high brightness image and the flicker effect (movement of a halo) caused by movement of the object are suppressed.

The backlight brightness determining unit 8 transmits the backlight brightness of the respective light sources determined in this manner to the brightness predicting unit and the backlight module unit 2. In the present embodiment, although the brightness has been determined using a lookup table, the brightness may be determined using a calculation formula.

The brightness predicting unit 9 predicts the brightness of light entering the liquid crystal panel unit 1 when the backlight module unit 2 is lit. In the present embodiment, it is assumed that the brightness predicting unit 9 predicts the brightness at the central points of the respective blocks. The brightness predicting unit 9 reads, from a memory, information on the intensity of light leaking to a surrounding region when the light sources of the backlight corresponding to the respective blocks are lit. In the present embodiment, is assumed that the information on the intensity of the leaking light is stored in a memory as an extinction coefficient at the central points of the respective blocks. The brightness predicting unit 9 predicts the brightness by multiplying the extinction coefficient read from the memory with the backlight brightness of the respective light sources determined by the backlight brightness determining unit 8. The brightness predicting unit 9 transmits the predicted brightness to the correction coefficient calculation unit 10.

The correction coefficient calculation unit 10 calculates a correction coefficient for correcting the image data from the prediction result on the brightness at the central points of the respective blocks calculated by the brightness predicting unit 9. The correction coefficient is a coefficient used for increasing a pixel value in order to compensate for a decrease in a display brightness when the brightness of the backlight is decreased. For a block in which the brightness of the backlight light source has increased so that the display brightness is higher than a target brightness, the correction coefficient calculation unit 10 calculates a correction coefficient so that the pixel value is corrected so as to decrease the brightness. When Lpn is a predicted brightness at the central point of a certain block, Lt is a target brightness when the pixel value is increased or adjusted according to a correction coefficient, and Gpn is a correction coefficient at the central point, the correction coefficient Gpn can be calculated according to the following equation.

$$Gpn=Lt/Lpn$$

The target brightness Lt is determined based on a peak brightness of a screen. Since brightness prediction is performed with respect to discrete central points, a correction coefficient corresponding to a pixel between the central points of blocks is calculated through interpolation based on the predicted brightness at the surrounding points and the positional relationship between a subject central point and the surrounding central points.

The correction coefficient multiplying unit 11 multiplies the image data of a corresponding pixel with the correction coefficient determined by the correction coefficient calculation unit 10 to correct the image data. The correction coefficient multiplying unit 11 transmits the corrected image data to the limit unit 12.

When the image data corrected by the correction coefficient multiplying unit 11 exceeds an input range of the liquid crystal panel unit 1, the limit unit 12 corrects the image data so as to fall into the input range.

The first embodiment has been described in detail above. With the configuration described above, when a difference between an image of a subject frame in which emission brightness is to be determined and an image of a past frame earlier than the subject frame is caused from movement of a predetermined object (for example, a mouser cursor), the emission brightness of a light source corresponding to an image region of the subject frame brighter than that of the past frame is suppressed from changing from the emission brightness of a light source corresponding to this image region of the past frame. Even when a high brightness object image (cursor) moves in a dark region of an image, it is possible to prevent any one of the block in which cursor existed before moving and the destination block from being lit bright by responding to a high brightness pixel value of the cursor. That is, since the respective light sources can be lit with the backlight brightness when no cursor was present in the original image, it is possible to ideally improve the contrast and suppress the halo effect and the flicker effect.

In the present embodiment, a method has been described in which the occurrence of the halo effect and the flicker effect resulting from a high brightness pixel that constitutes the cursor is suppressed by using, as the feature amounts of the destination block of the cursor, the feature amounts calculated when the cursor was not present, without updating those feature amounts. However, the destination block of the cursor as well as the surrounding blocks are a dark region of the image, the display brightness of the cursor may decrease and the visibility of the cursor may decrease. Thus, the feature amount storage unit 6 may calculate an average value of the feature amounts of blocks of the past and current frames and update the feature amounts of the destination block of the cursor with the average value. By doing so, the visibility of the cursor can be improved to such an extent that the user does not feel any sense of disturbance. In the present embodiment, the emission brightness of a light source corresponding to an image region of a subject frame in which the emission brightness is to be determined and which is brighter than that of the past frame may not be changed from the emission brightness of the light source corresponding to the image region of the past frame. Alternatively, the emission brightness of the light source corresponding to the bright image region in the subject frame may be decreased from the emission brightness corresponding to the bright image region so that a change in the emission brightness of the light source corresponding to the corresponding region of the past frame is suppressed.

Second Embodiment

In the first embodiment, the feature amount when no cursor was present in the current frame is calculated from the feature amount of the current frame and the stored feature amount of the past frame, and the backlight brightness to be applied to displaying of the current frame is determined based on the feature amount. In the second embodiment, the backlight brightness when no cursor was present in the current frame is calculated from the backlight brightness determined from the feature amount of the current frame and a past backlight brightness. By doing so, similarly to the first embodiment, an image display apparatus that performs local dimming control according to an input image to improve the contrast can suppress both the halo effect and the flicker effect when a high brightness cursor moves in a dark region of the image.

Figure 7:
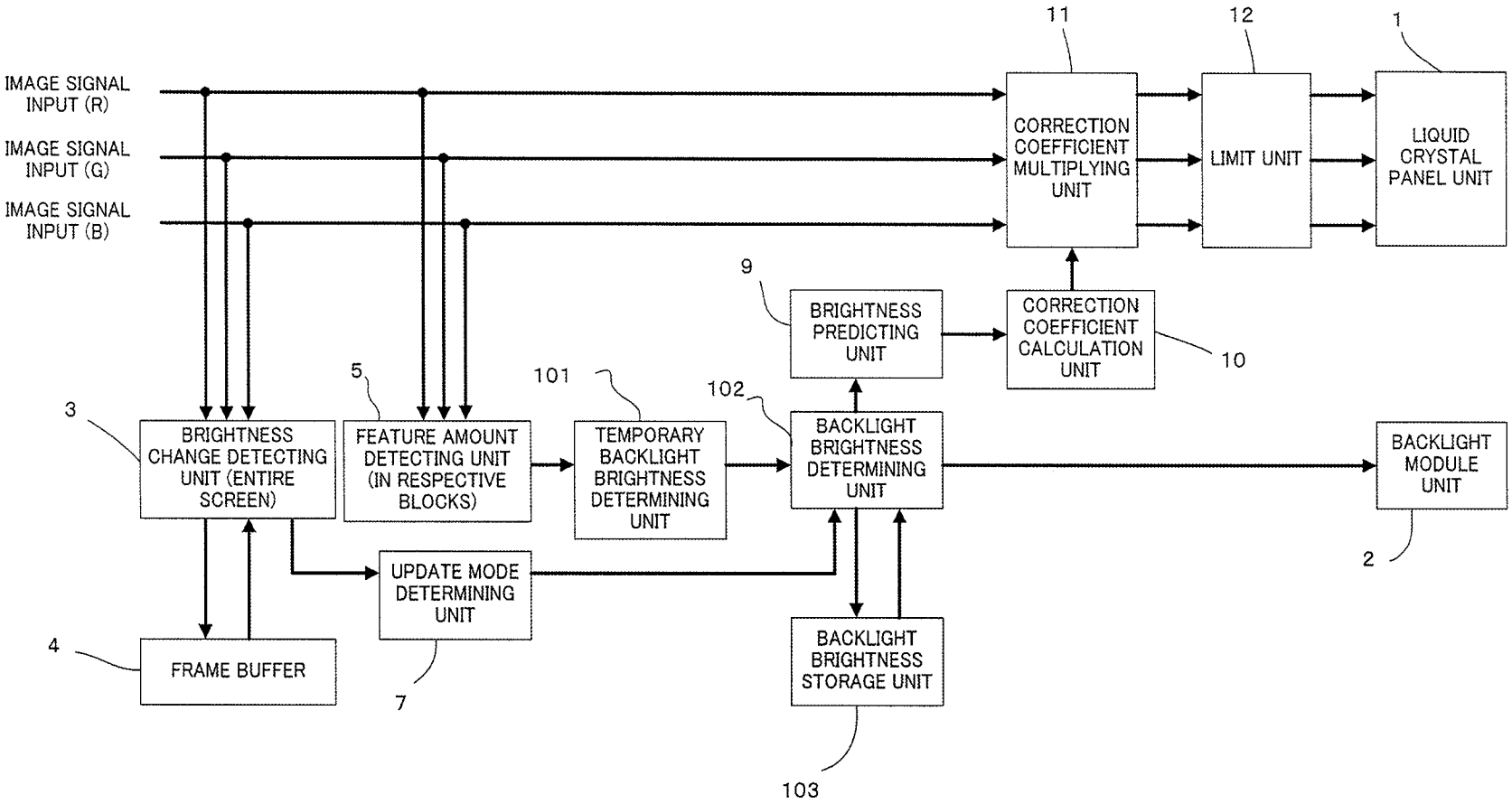
FIG. 7 is a functional block diagram of an image display apparatus according to a second embodiment.

FIG. 7 illustrates a functional block diagram of an image display apparatus according to the second embodiment. The image display apparatus illustrated in FIG. 7 includes a liquid crystal panel unit 1, a backlight module unit 2, a brightness change detecting unit 3, a frame buffer 4, a feature amount detecting unit 5, a update mode determining unit 7, a temporary backlight brightness determining unit 101, a backlight brightness determining unit 102, a backlight brightness storage unit 103, a brightness predicting unit 9, a correction coefficient calculation unit 10, a correction coefficient multiplying unit 11, and a limit unit 12.

The liquid crystal panel unit 1, the backlight module unit 2, the brightness change detecting unit 3, the frame buffer 4, the feature amount detecting unit 5, the update mode determining unit 7, the brightness predicting unit 9, the correction coefficient calculation unit 10, the correction coefficient multiplying unit 11, and the limit unit 12 are the same as those of the first embodiment, and description thereof will not be provided.

The temporary backlight brightness determining unit 101 temporarily determines the backlight brightness of respective light sources based on the feature amounts detected by the feature amount detecting unit 5. In the present embodiment, similarly to the first embodiment, the backlight brightness of the light sources corresponding to the respective blocks is temporarily determined based on the largest pixel values of the respective blocks. The determination method is the same as that used by the backlight brightness determining unit 8 of the first embodiment, and description thereof will not be provided.

The backlight brightness determining unit 102 determines the backlight brightness based on the backlight brightness temporarily determined by the temporary backlight brightness determining unit 101 and the backlight brightness stored in the backlight brightness storage unit 103. Specifically, the backlight brightness determining unit 102 determines the backlight brightness of each of the light sources based on the update mode determined by the update mode determining unit 7.

In the update mode 0, the backlight brightness determining unit 102 determines the backlight brightness temporarily determined by the temporary backlight brightness determining unit 101 as the backlight brightness to be applied to displaying of the current frame with respect to all light sources. Moreover, the backlight brightness determining unit 102 substitutes (updates) the backlight brightness of all light sources stored in the backlight brightness storage unit 103 with the backlight brightness temporarily determined by the temporary backlight brightness determining unit 101.

In the update mode 1, it can be determined that it is a scene in which the cursor has moved. The backlight brightness determining unit 102 compares the brightness temporarily determined by the temporary backlight brightness determining unit 101 with the past brightness stored in the backlight brightness storage unit 103 and selects the lower brightness as the backlight brightness to be applied to displaying of the current frame. Moreover, the backlight brightness determining unit 102 updates the backlight brightness of the light source of which the brightness temporarily determined by the temporary backlight brightness determining unit 101 is selected as the backlight brightness to be applied to displaying the current frame with the selected backlight brightness.

The backlight brightness will be described with reference to FIGS. 8A and 8B. FIG. 8A illustrates the backlight brightness temporarily determined by the temporary backlight brightness determining unit 101 and FIG. 8B illustrates the backlight brightness stored in the backlight brightness storage unit 103. The numbers in respective blocks of FIGS. 8A and 8B represent the backlight brightness. The numbers 1 to 8 and 1 to 6 in the horizontal and vertical directions outside the lattice represent the coordinates in the horizontal and vertical directions, respectively.

The brightness of a light source at the coordinate (3,2) is 0 in FIG. 8A and 100 in FIG. 8B. Thus, the backlight brightness determining unit 102 selects the lower brightness (that is, the backlight brightness temporarily determined by the temporary backlight brightness determining unit 101 illustrated in FIG. 8A) as the backlight brightness applied to displaying of the current frame. Further, an instruction is transmitted to the backlight brightness storage unit 103 so as to update the stored brightness of the light source at the coordinate (3,2) with the backlight brightness determined temporarily.

Moreover, the brightness of light sources at the coordinates (5,2) and (6,2) is 100 in FIG. 8A and 0 in FIG. 8B. Thus, the backlight brightness determining unit 102 selects the lower brightness (that is, the backlight brightness stored in the backlight brightness storage unit 103 illustrated in FIG. 8B) as the backlight brightness applied to displaying of the current frame.

As for the light sources of the other blocks, since the backlight brightness temporarily determined by the temporary backlight brightness determining unit 101 has not changed from the backlight brightness stored in the backlight brightness storage unit 103, any one of the backlight brightness may be used as the backlight brightness to be applied to displaying of the current frame. In such a case, in the present embodiment, the value determined by the temporary backlight brightness determining unit 101 is used as the backlight brightness to be applied to displaying the current frame.

The backlight brightness applied to displaying of the current frame determined in this manner is as illustrated in FIG. 6 similarly to the first embodiment.

In the update mode 2, since there is no change in the image, any one of the backlight brightness temporarily determined by the temporary backlight brightness determining unit 101 and the backlight brightness stored in the backlight brightness storage unit 103 may be used as the backlight brightness applied to displaying the current frame. In the present embodiment, the brightness stored in the backlight brightness storage unit 103 is used.

The backlight brightness determining unit 102 outputs the information on the backlight brightness applied to displaying of the current frame determined in this manner to the brightness predicting unit 9 and the backlight module unit 2 which are on the subsequent stage.

The second embodiment has been described in detail above. With the configuration described above, similarly to the first embodiment, even when a high brightness object image (cursor) moves in a dark region of an image, it is possible to prevent any one of the block in which cursor existed before moving and the destination block from being lit bright by responding to a high brightness pixel value of the cursor. That is, since the respective light sources can be lit with the backlight brightness when no cursor was present in the original image, it is possible to ideally improve the contrast by local dimming control and suppress the halo effect and the flicker effect.

Third Embodiment

In the first and second embodiments, the number of pixels of which the brightness has changed between adjacent frames is counted, and the counted value is compared with a threshold to detect a scene in which a cursor has moved. In a third embodiment, the cursor itself is detected as an object to detect a scene in which the cursor has moved. Moreover, a feature amount when no cursor was present in the current frame is calculated from a feature amount of the current frame and a stored feature amount of a past frame, and a backlight brightness to be applied to displaying of the current frame is determined based on the feature amount. By doing so, similarly to the first and second embodiments, an image display apparatus that performs local dimming control according to an input image to improve the contrast can suppress both the halo effect and the flicker effect when a high brightness cursor moves in a dark region of the image. Moreover, since the cursor itself is recognized, erroneous determination on a cursor movement scene can be reduced as compared to the first and second embodiments.

Figure 9:
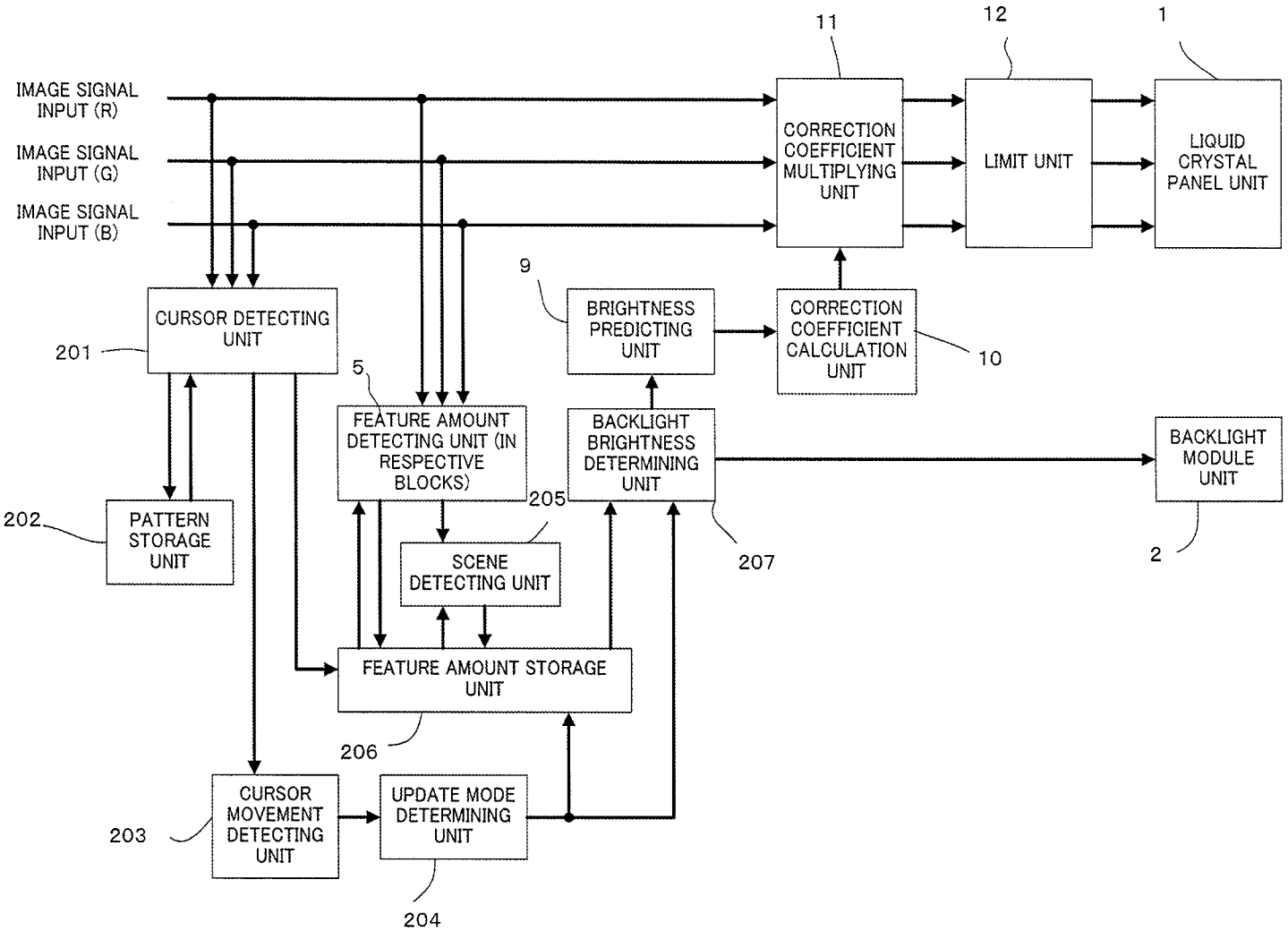
FIG. 9 is a functional block diagram of an image display apparatus according to a third embodiment.

FIG. 9 illustrates a functional block diagram of an image display apparatus according to the third embodiment. The image display apparatus illustrated in FIG. 9 includes a liquid crystal panel unit 1, a backlight module unit 2, a cursor detecting unit 201, a pattern storage unit 202, a cursor movement detecting unit 203, a update mode determining unit 204, a scene detecting unit 205, a feature amount storage unit 206, a feature amount detecting unit 5, a backlight brightness determining unit 207, a brightness predicting unit 9, a correction coefficient calculation unit 10, a correction coefficient multiplying unit 11, and a limit unit 12.

The liquid crystal panel unit 1, the backlight module unit 2, the feature amount detecting unit 5, the brightness predicting unit 9, the correction coefficient calculation unit 10, the correction coefficient multiplying unit 11, and the limit unit 12 are the same as those of the first embodiment, and description thereof will not be provided.

The cursor detecting unit 201 detects a cursor from image data. The cursor is detected in such a way that possible shapes of a cursor are stored and it is examined whether an object having a shape matching any one of the stored patterns is present in the image data. Pattern information on the cursor shape is stored in the pattern storage unit 202, and the cursor detecting unit 201 reads the pattern information from the pattern storage unit 202 as necessary. When the cursor is detected, the cursor detecting unit 201 obtains a central pixel of the detected cursor and the coordinate of a block to which the cursor belongs. The cursor detecting unit 201 outputs the position information of the central pixel of the cursor among the obtained items of information to the cursor movement detecting unit 203. The cursor detecting unit 201 outputs the information on the coordinate of the block to which the cursor belongs to the feature amount storage unit 206.

The cursor movement detecting unit 203 stores the position information of the central pixel of the cursor detected by the cursor detecting unit 201 and detects that the position of the central pixel of the cursor has changed. Specifically, the cursor movement detecting unit 203 compares the stored position of the central pixel of the cursor with the new position of the central pixel of the cursor received from the cursor detecting unit 201 to examine whether the pixel position has changed.

When there is a change in the position of the central pixel of the cursor, the cursor movement detecting unit 203 transmits a value "1" to the update mode determining unit 204, indicating that the cursor has moved.

When there is no change in the central pixel of the cursor and the cursor is detected, the cursor movement detecting unit 203 transmits a value "2" to the update mode determining unit 204, indicating that the cursor is present but the cursor has not moved.

When the cursor is not detected, the cursor movement detecting unit 203 transmits a value "0" to the update mode determining unit 204, indicating that the cursor is not present.

The update mode determining unit 204 transmits information on the update mode to the feature amount storage unit 206 and the backlight brightness determining unit 207. Upon receiving the value "1" from the cursor movement detecting unit 203, indicating that the cursor has moved, the update mode determining unit 204 sets the update mode 1. Upon receiving the value "2" indicating that the cursor has been detected but the cursor has not moved, the update mode determining unit 204 sets the update mode 2. Upon receiving the value "0" indicating that the cursor has not been detected, the update mode determining unit 204 sets the update mode 0.

The scene detecting unit 205 determines whether the image is a still image or a moving image based on a change in the feature amount between adjacent frames. Even when the image is a still image, if the image changes, the image is determined to be a moving image. The scene detecting unit 205 reads the feature amount detected by the feature amount detecting unit 5 and the feature amount stored in the feature amount storage unit 206 and counts the number of blocks of which the feature amount has changed. In the present embodiment, the scene detecting unit 205 counts the number of blocks in which the largest feature amount has changed. In the present embodiment, although a scene change is determined based on the largest feature amount, an average feature amount may be used in determination of a scene change. Alternatively, a scene change may be determined based on both the largest feature amount and the average feature amount. When the number of blocks in which the largest feature amount has changed is equal to or larger than a predetermined threshold, the scene detecting unit 205 determines that the input image is a moving image and outputs the value "1" to the feature amount storage unit 206, indicating the input image is a moving image. In other cases, the scene detecting unit 205 outputs the value "0" to the feature amount storage unit 206, indicating that the input image is a still image.

The feature amount storage unit 206 stores the feature amount detected by the feature amount detecting unit 5. The feature amount storage unit 206 receives the determination results from the update mode determining unit 204 and the scene detecting unit 205 and selects a block of which the data is to be updated. FIG. 10 illustrates the relationship among the update mode determined by the update mode determining unit 204, the determination result in the scene detecting unit 205, and an updating block selection method. When a scene determination result is "1" (that is, the input image is a moving image), the feature amount storage unit 206 updates the stored feature amounts of all blocks with the feature amounts of the current frame detected by the feature amount detecting unit 5 regardless of the update mode determination result in the update mode determining unit 204. On the other hand, when the determination result in the scene detecting unit 205 is "0", different processes are performed depending on the update mode.

In the case of the update mode 0, no cursor is present. Thus, the feature amount storage unit 206 updates the feature amounts of all blocks with the feature amounts of the current frame detected by the feature amount detecting unit 5.

In the case of the update mode 1, a scene in which the cursor has moved is detected. When the input image is a still image and the cursor has moved, there is a possibility that the halo effect and the flicker effect occur due to movement of the cursor. Thus, in order to suppress an increase in the backlight brightness in the destination block of the cursor, the feature amount storage unit 206 does not update with the feature amounts detected by the feature amount detecting unit 5 with respect to the destination block of the cursor. The feature amount storage unit 206 receives the coordinate of the destination block of the cursor from the cursor detecting unit 201. On the other hand, the feature amount storage unit 206 updates the feature amounts of the block in which cursor existed before moving and the other blocks with the feature amounts detected by the feature amount detecting unit 5.

In the case of the update mode 2, since the input image is a still image and the cursor has not moved, the feature amount storage unit 206 does not update the feature amounts of all blocks.

The backlight brightness determining unit 207 determines the backlight brightness of the light sources corresponding to the respective blocks according to the feature amounts stored in the feature amount storage unit 206. The determination method is the same as the first embodiment, and description thereof will not be provided.

The third embodiment has been described in detail above. With the configuration described above, similarly to the first and second embodiments, even when a high brightness object image (cursor) moves in a dark region of an image, it is possible to improve the contrast and suppress the halo effect and the flicker effect. Moreover, since the cursor itself is recognized, erroneous determination on a cursor movement scene can be reduced as compared to the first and second embodiments.

Fourth Embodiment

In the embodiments described above, movement of a mouse cursor is detected and a backlight brightness is controlled based on a past statistic and a past backlight brightness, whereby a change in the brightness of a backlight resulting from the movement of the mouse cursor is suppressed or prevented. By doing so, the halo effect and the flicker effect due to the movement of the mouse cursor are suppressed.

In the fourth embodiment, a scene in which a mouse cursor has moved is detected and a destination block of the mouse cursor is specified. As for the destination block of the mouse cursor, the rate of change (a change rate, an amount of change per frame, or an amount of change per unit period) in the backlight brightness corresponding to a change in a feature amount is set to be smaller than that of a normal block. The normal block is a block other than the destination block of the mouse cursor. According to this, the backlight is suppressed from becoming bright suddenly due to a mouse cursor made up of bright pixels appearing in the destination block of the mouse cursor. Moreover, even when a mouse cursor stops in a destination block of the mouse cursor, since the brightness of the backlight of the destination block increases slowly, it is possible to suppress the flicker effect from being recognized.

Figure 12:
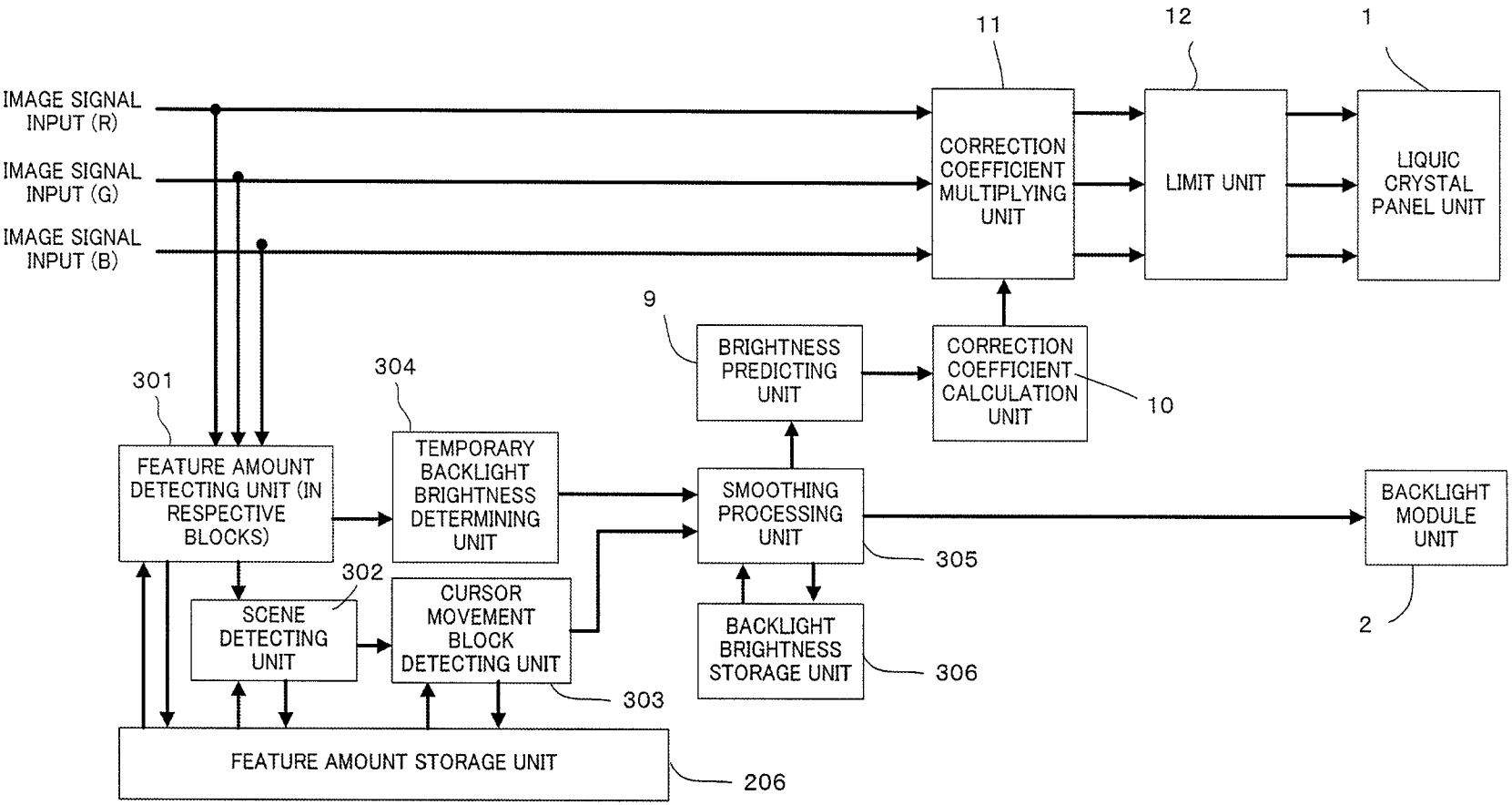
FIG. 12 is a functional block diagram of an image display apparatus according to a fourth embodiment.

FIG. 12 illustrates a functional block diagram of an image display apparatus according to the fourth embodiment. The image display apparatus illustrated in FIG. 12 includes a liquid crystal panel unit 1, a backlight module unit 2, a feature amount detecting unit 301, a feature amount storage unit 206, a scene detecting unit 302, a cursor movement block detecting unit 303, a temporary backlight brightness determining unit 304, and a smoothing processing unit 305. The image display apparatus illustrated in FIG. 12 further includes a backlight brightness storage unit 306, a brightness predicting unit 9, a correction coefficient calculation unit 10, a correction coefficient multiplying unit 11, and a limit unit 12.

The feature amount detecting unit 301 detects a largest value or an average value of the pixel values in respective blocks corresponding to the light sources of the backlight similarly to the first embodiment, counts the number of bright pixels in respective blocks, and acquires the number as a feature amount. Here, bright pixels are pixels of which the pixel values (gradation values) are equal to or larger than a predetermined threshold. A value that is typical as a pixel value of a pixel that constitutes an image of the mouse cursor, for example, can be set as the threshold.

The scene detecting unit 302 determines a scene in which a mouse cursor has moved. The scene detecting unit 302 determines a scene as the scene in which the cursor has moved, for example, when the number of blocks in which the largest value of a pixel value in the block has increased between frames is equal to or smaller than a threshold and the number of blocks in which the largest value of a pixel value in the block has decreased between frames is equal to or smaller than a threshold. Alternatively, the scene detecting unit 302 may determine a scene as the scene in which the cursor has moved when the sum in all blocks, of the absolute values of the differences between frames of the average values of the pixel values in the respective blocks is equal to or smaller than a threshold. Alternatively, the scene detecting unit 302 may determine a scene as the scene in which the cursor has moved when both of the conditions above are satisfied. Alternatively, the scene detecting unit 302 may detect a movement of a cursor using the method described in the first to third embodiments and detect a scene in which the cursor has moved using the detection results. The scene detecting unit 302 outputs the scene determination result to the cursor movement block detecting unit 303.

The cursor movement block detecting unit 303 detects a destination block of the cursor when the scene in which the cursor has moved is detected by the scene detecting unit 302. The cursor movement block detecting unit 303 acquires the number of bright pixels in a subject block subject to determining whether the block is a destination block of the cursor. The cursor movement block detecting unit 303 determines that the subject block is a destination block of the cursor when the number of bright pixels in the subject block is equal to or larger than 1 and equal to or smaller than a threshold, and a difference between the average value of the pixel value of the subject block and the average value of the pixel values of the surrounding blocks is equal to or smaller than a threshold. The cursor movement block detecting unit 303 outputs information on the block detected as the destination block of the cursor to the smoothing processing unit 305.

The temporary backlight brightness determining unit 304 temporarily determines the backlight brightness of respective light sources based on the feature amounts detected by the feature amount detecting unit 301 similarly to the first to third embodiments. The temporary backlight brightness determining unit 304 transmits the temporarily determined backlight brightness of respective light sources to the smoothing processing unit 305.

The smoothing processing unit 305 determines a backlight brightness of the respective light sources based on the backlight brightness determined by the temporary backlight brightness determining unit 304 and the backlight brightness of one frame before, stored in the backlight brightness storage unit 306. That is, the smoothing processing unit 305 controls the amount of change in the emission brightness of a light source based on the amount of change in the brightness of an image from a past frame to a subject frame subject to determining the emission brightness, and the ratio of the amount of change in the emission brightness to the amount of change in the image brightness is expressed by a predetermined coefficient. When the backlight brightness temporarily determined by the temporary backlight brightness determining unit 304 is higher than the backlight brightness applied for displaying of the previous frame, the smoothing processing unit 305 calculates the difference therebetween and adds a value obtained by multiplying the difference by a predetermined coefficient to the backlight brightness of the previous frame. This coefficient represents the ratio of the amount of change in the emission brightness of a light source to the amount of change in the image brightness between the present frame and the previous frame.

For example, when the backlight brightness of a previous frame is L(−1) and the temporarily determined backlight brightness of the present frame is preL(0), the difference ΔL is calculated as follows.

$$\Delta L = preL(0) - L(-1)$$

For blocks which are not detected as the destination block of the cursor by the cursor movement block detecting unit 303, the smoothing processing unit 305 calculates the backlight brightness L(0) of the present frame as follows.

$$L(0) = L(-1) + \Delta L \times A/100$$

Here, the coefficient is A (%). On the other hand, the smoothing processing unit 305 uses a coefficient B (%) for blocks which are detected as the destination block by the cursor movement block detecting unit 303. Here, A>>B. The smoothing processing unit 305 calculates the backlight brightness of the destination block of the cursor as follows.

$$L(0) = L(-1) + \Delta L \times B/100$$

That is, the backlight brightness of the present frame is determined based on the coefficient A for normal blocks which are not the destination block of the cursor, whereas the backlight brightness of the present frame is determined based on the coefficient B for the destination blocks of the cursor. In the destination block of the cursor, the feature amount indicating the brightness in the block increases due to the cursor having moved into the block, and the backlight brightness temporarily determined based on the feature amount also increases. However, since A>>B, the increase in the backlight brightness finally determined is suppressed. Due to this, since the increase in the backlight brightness caused by the cursor is suppressed, it is possible to suppress the flicker effect and the halo effect.

In order to sufficiently suppress the change in the backlight brightness in the destination block of the cursor, B may be set to a value that is equal to or smaller than 1/100 of A.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-125312, filed on Jun. 14, 2013, and Japanese Patent Application No. 2014-107371, filed on May 23, 2014, which are hereby incorporated by reference herein in their entirety.

What is claimed is:

1. An image display apparatus comprising:

a light-emitting unit having a plurality of light sources;

a display unit having a plurality of regions corresponding to the plurality of light sources, respectively, the display unit displaying an image by modulating light emitted from the light-emitting unit based on a frame inputted to the display unit;

a control unit that controls an emission brightness of each of the plurality of light sources corresponding to each of the plurality of regions based on a brightness of each of a plurality of regions in the frame inputted to the display unit; and a determining unit that determines whether a predetermined assisting object for assisting a user's operation has moved between a first frame and a second frame, the first frame being input to the display unit before the second frame, wherein the control unit controls the emission brightness of each of the plurality of light sources of the display unit during displaying the second frame based on a value obtained by adding a value obtained by multiplying, by a coefficient, a difference between a first emission brightness of each of the plurality of light sources at emitting light of the display unit during displaying the first frame and a second emission brightness calculated based on the brightness of each of the plurality of regions in the second frame to the first emission brightness, wherein in a case where the determining unit determines that the predetermined assisting object has moved between the first frame and the second frame, a coefficient A, which is used for controlling the emission brightness of a light source corresponding to a second region where the predetermined assisting object is not present in the second frame among the plurality of regions, is larger than a coefficient B, which is used for controlling the emission brightness of a light source corresponding to a first region where the predetermined assisting object is present in the second frame.

2. The image display apparatus according to claim 1, wherein in a case where the determining unit determines that the predetermined assisting object has not moved between the first frame and the second frame, the control unit controls the emission brightness of the plurality of light sources using the coefficient A.

3. The image display apparatus according to claim 1, wherein in a case where the number of pixels of which the brightness is different between the first frame and the second frame is equal to or smaller than a threshold, the determining unit determines that the predetermined assisting object has moved between the first frame and the second frame.

4. The image display apparatus according to claim 1, wherein in a case where an object having a shape matching a possible shape of the predetermined assisting object is present at least in the second frame and the position of the object is different between the first frame and the second frame, the determining unit determines that the predetermined assisting object has moved between the first frame and the second frame.

5. The image display apparatus according to claim 1, wherein in a case where the sum of the absolute values of the differences between the maximum values of the pixel values in each of the plurality of regions in the first frame and the maximum values of the pixel values in each of the plurality of regions in the second frame is equal to or smaller than a first threshold, and the number of regions, where the maximum value of the pixel values are larger in the first frame than in the second frame, is equal to or smaller than a second threshold, the determining unit determines that the predetermined assisting object has moved between the first frame and the second frame.

6. The image display apparatus according to claim 1, further comprising:

a storage unit that stores a first emission brightness of each of the plurality of light sources at emitting light on the display unit during displaying the first frame; and a temporary determining unit that determines a second emission brightness of each of the plurality of light sources based on the brightness of each of the plurality of regions in the second frame, wherein the control unit controls the emission brightness of each of the plurality of light sources by adding a value, determined based on a difference between the first emission brightness and the second emission brightness, to the first emission brightness.

7. The image display apparatus according to claim 1, wherein in a case where the first frame and the second frame excluding the predetermined assisting object constitute a moving image, the control unit controls the emission brightness of each of the plurality of light sources based on each of the plurality of regions of the second frame corresponding to each of the plurality of light sources.

8. The image display apparatus according to claim 1, wherein in a case where the determining unit determines that the predetermined assisting object has not moved between the first frame and the second frame, the control unit controls the emission brightness of each of the plurality of light sources based on each of the plurality of regions of the first frame corresponding to each of the plurality of light sources.

9. The image display apparatus according to claim 8, wherein the threshold is set based on the number of pixels of the predetermined assisting object.

10. The image display apparatus according to claim 1, wherein in a case where the sum of the absolute values of the differences between frames of the average values of the pixel values in each of the plurality of regions is equal to or smaller than a threshold, the determining unit determines that the predetermined assisting object has moved between the first frame and the second frame.

11. The image display apparatus according to claim 1, wherein the size of the predetermined assisting object is smaller than that of a region corresponding to one light source of the plurality of light sources, and the predetermined assisting object is a high brightness object image.

12. The image display apparatus according to claim 1, wherein the predetermined assisting object is a cursor.

13. An image display apparatus comprising:

a plurality of light sources;

a display unit having a plurality of regions corresponding to the plurality of light sources, respectively, the display unit displaying an image by modulating light emitted from the plurality of light sources based on a frame inputted to the display unit;

a control unit that controls an emission brightness of each of the plurality of light sources corresponding to each of the plurality of regions based on a brightness of each of a plurality of regions in the frame inputted to the display unit;

a determining unit that determines whether the number of regions of which characteristic value changes between a first frame and a second frame is equal to or smaller than a predetermined number, the first frame being input to the display unit before the second frame; and a detecting unit that detects a first region where a predetermined object is present in the second frame, wherein the control unit controls the emission brightness of each of the plurality of light sources so that an amount of change in a case where the determining unit determines that the number of regions is equal to or smaller than the predetermined number is smaller than an amount of change in a case where the determining unit determines that the number of regions is more than the predetermined number, the change being a change of the emission brightness of the light source corresponding to the first region from the first frame to the second frame, and the detecting unit determines that a target region among the plurality of regions in the second frame is the first region in a case where the number of bright pixels of the target region is equal to or smaller than a third threshold, and the difference between the average value of the pixel values in the target region and the average value of the pixel values in regions around the target region is equal to or smaller than a fourth threshold.

14. A method of controlling an image display apparatus including:

a light-emitting unit having a plurality of light sources; and a display unit having a plurality of regions corresponding to the plurality of light sources, respectively, the display unit displaying an image by modulating light emitted from the light-emitting unit based on a frame inputted to the display unit, the method comprising:

controlling an emission brightness of each of the plurality of light sources corresponding to each of the plurality of regions based on a brightness of each of a plurality of regions in the frame inputted to the display unit; and determining whether a predetermined assisting object for assisting a user's operation has moved between a first frame and a second frame, the first frame being input to the display unit before the second frame, wherein the emission brightness of each of the plurality of light sources of the display unit during displaying the second frame is controlled based on a value obtained by adding a value obtained by multiplying, by a coefficient, a difference between a first emission brightness of each of the plurality of light sources at emitting light of the display unit during displaying the first frame and a second emission brightness calculated based on the brightness of each of the plurality of regions in the second frame to the first emission brightness, wherein in a case where it is determined in the determining that the predetermined assisting object has moved between the first frame and the second frame, a coefficient A, which is used for controlling the emission brightness of a light source corresponding to a second region where the predetermined assisting object is not present in the second frame among the plurality of regions, is larger than a coefficient B, which is used for controlling the emission brightness of a light source corresponding to a first region where the predetermined assisting object is present in the second frame.

* * * * *